United States Patent [19]

Arnold

[11] 4,345,872

[45] Aug. 24, 1982

[54] CONNECTORS

[75] Inventor: Carroll H. Arnold, Westminster, Mass.

[73] Assignee: Wain-Roy, Inc., Hubbardston, Mass.

[21] Appl. No.: 923,379

[22] Filed: Jul. 10, 1978

[51] Int. Cl.[3] ..... E02F 3/70

[52] U.S. Cl. ..... 414/705; 414/723

[58] Field of Search ..... 414/723, 705, 694, 695, 414/607, 394; 37/117.5, 103, 118, 118 A; 172/272, 275

[56] References Cited

U.S. PATENT DOCUMENTS

| | | | |
|---|---|---|---|
| 2,963,183 | 12/1960 | Przybylski . | |
| 3,231,116 | 1/1966 | Powell . | |
| 3,556,323 | 1/1971 | Heimmermann | 414/723 |
| 3,896,950 | 7/1975 | McCain | 414/694 |
| 3,934,738 | 1/1976 | Arnold . | |
| 4,042,131 | 8/1977 | Buttke | 414/694 |
| 4,067,467 | 1/1978 | Datta et al. | 414/723 |

*Primary Examiner*—Leslie J. Paperner

[57] ABSTRACT

Apparatus for releasably securing a materials handler to a boom while permitting rotation of the materials handler about relatively perpendicular first and second axes. A first connector system includes a member attached to a hitch extending along the second axis and having a tapered nose arranged to engage an aperture in an upwardly projecting member attached to the materials handler. A second connector system includes a recess in one of the hitch and handler having axially aligned apertures through opposite walls thereof and a projection defined by the other of the hitch and handler arranged to fit within the recess. An arm attached to the hitch for rotation relative thereto about the second axis projects towards and engages cooperating structure on the materials handler so that rotation of the arm causes the materials handler to rotate relative to the hitch about the second axis.

8 Claims, 9 Drawing Figures

FIG 1
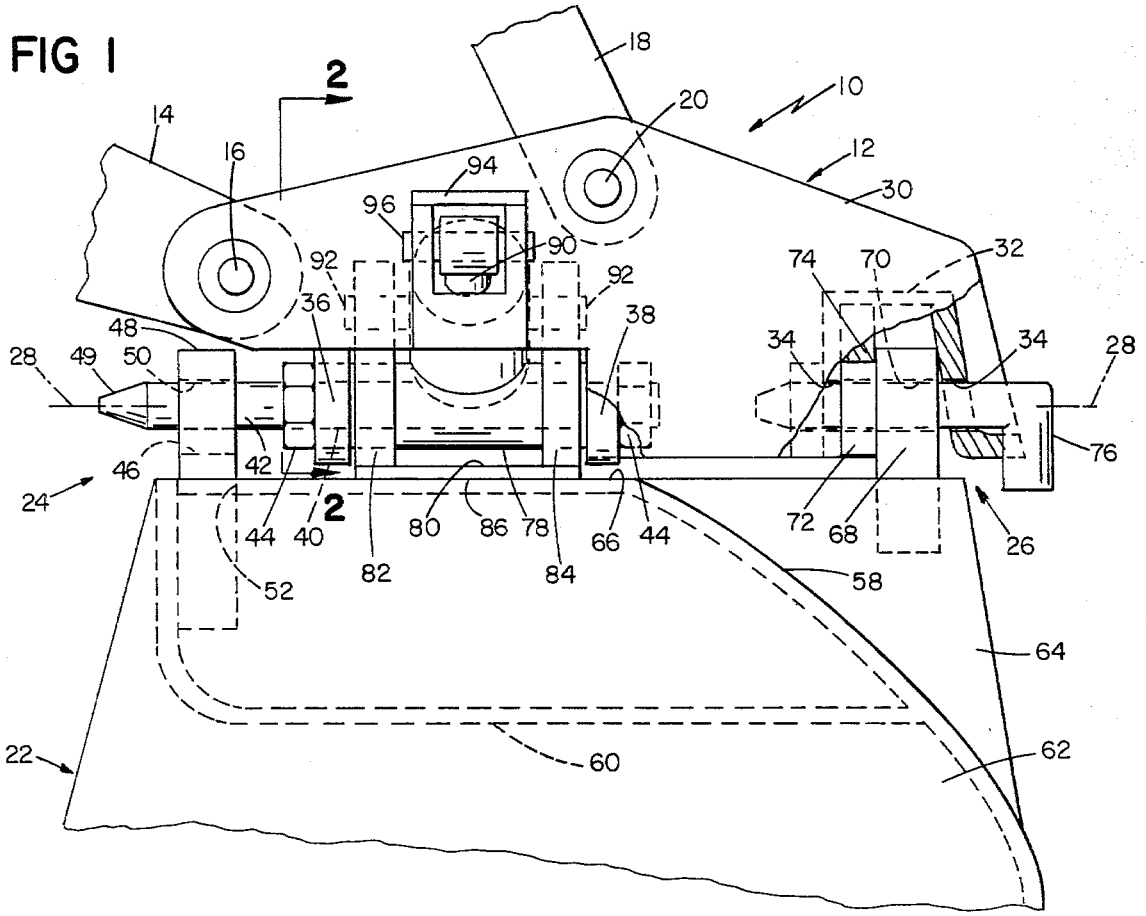
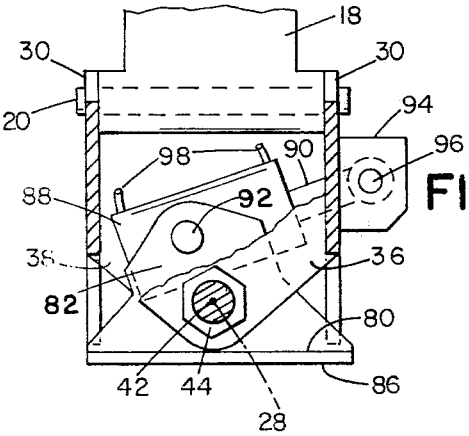
FIG 2
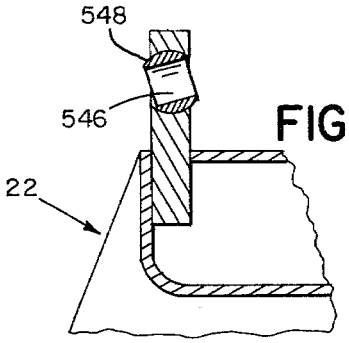
FIG 5
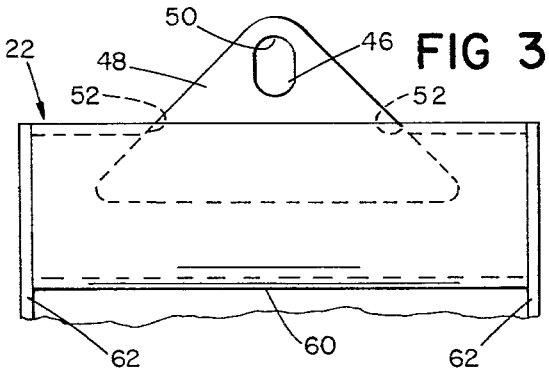
FIG 3
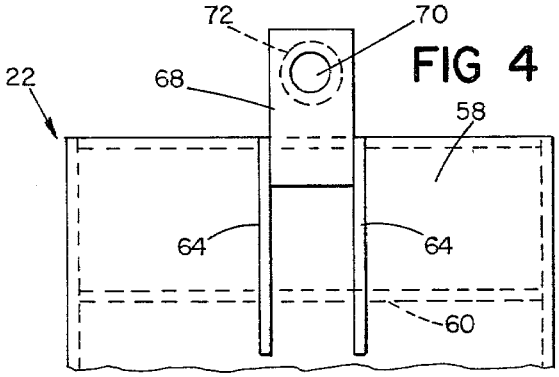
FIG 4

CONNECTORS

BACKGROUND OF THE INVENTION

This invention relates to materials handling and, more particularly, to mounting materials handling tools, e.g., buckets, blades, rippers, augers and the like on the dipperstick of a backhoe.

Such tools are generally mounted to the dipperstick so as to be rotatable about a horizontal axis located at the end of the dipperstick. It is generally desirable to also be able to rotate the tool about a second axis generally perpendicular to the first axis, i.e., to provide a wrist-like joint where the tool is connected to the dipperstick. The hitch should allow changing the tool mounted on the dipperstick without time consuming and laborious effort and without the danger to the operator that arises from manual handling of the tools. There have appeared suggestions for accomplishing these goals, as shown in my prior U.S. Pat. No. 3,934,738, herein incorporated by reference.

SUMMARY OF THE INVENTION

The present invention provides a system for releasably connecting any of a wide range of materials handling tools to any type of backhoe in a manner allowing rotation of the tool about a second axis generally perpendicular to a first, horizontal axis located at the end of the dipperstick boom. The system is simple and effective and does not require extensive modification of conventional materials handling tools.

The invention features a hitch adapted for connection to the dipperstick boom for rotation about the first axis, a or first connector system including a first hitch connector attached to the hitch and extending along the second axis and defining a tapered nose at one end thereof arranged to be received in an aperture in a member projecting upwardly from the handler, a second connector system including a recess defined by one of the hitch and handler and having apertures in opposite walls thereof, a projection on the other of the hitch and handler arranged to fit within the recess, and an arm attached to the hitch for rotation relative thereto and projecting towards and engaging cooperating structure on the materials handler, whereby rotation of the arm causes the materials handler to rotate relative to the hitch about the second axis.

In preferred embodiments, an axially extending pin is supported by the hitch at points spaced along the second axis, a cylindrical sleeve surrounds the pin intermediate the supports, and the arm is attached to and projects from the periphery of the sleeve.

Other features are described in or will appear from the following description of preferred embodiments.

DESCRIPTION OF THE PREFERRED EMBODIMENT

We turn now to the structure and operation of a preferred embodiment of the invention, after first briefly describing the drawings.

DRAWINGS

FIG. 1 is a partly broken away side elevation of portions of a backhoe dipperstick and a materials handling tool, and a hitch connecting the tool to the dipperstick.

FIG. 2 is a sectional view, partly broken away, along 2—2 of FIG. 1.

FIGS. 3 and 4 are end views of portions of the apparatus of FIG. 1.

FIG. 5 is a sectional side view of a modification of a portion of the apparatus of FIG. 1.

STRUCTURE

Figure 6:
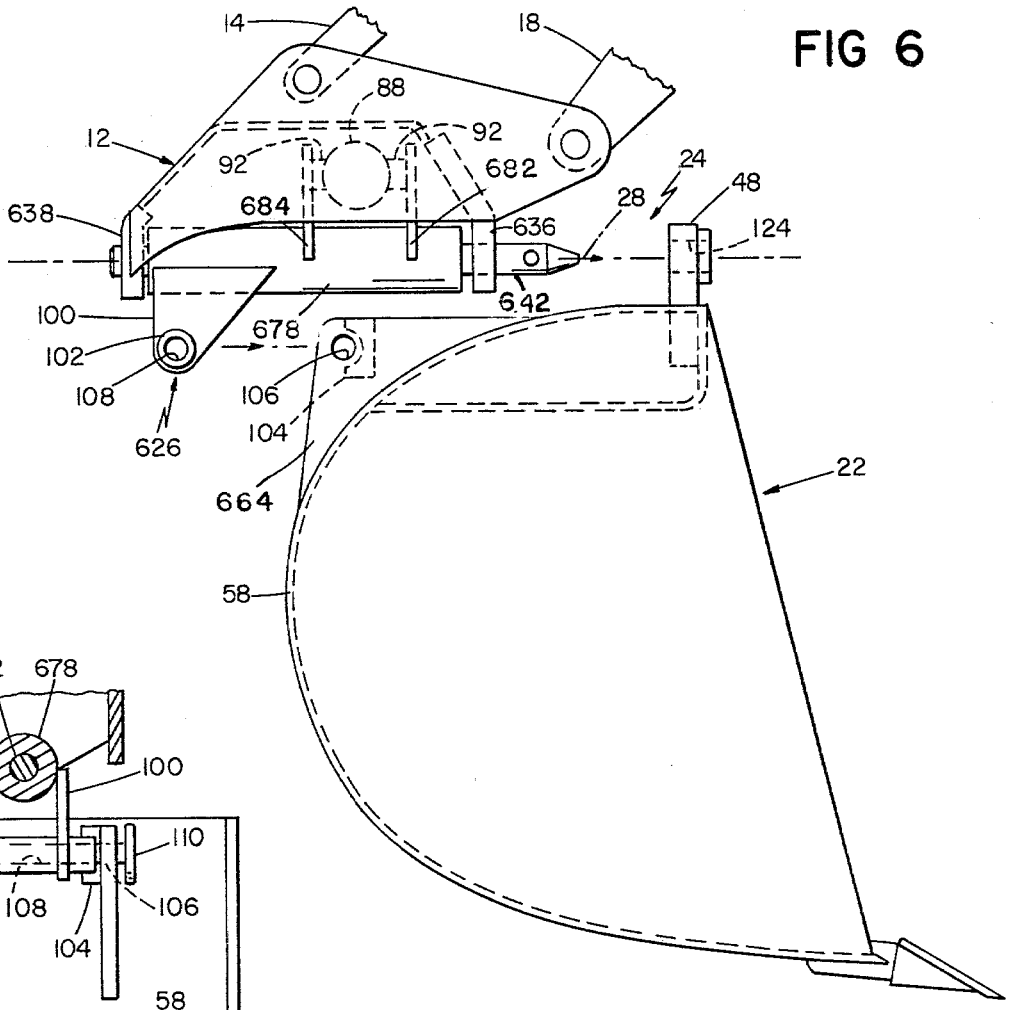
FIG. 6 is a side elevation of a modification of the present invention.

Referring to FIGS. 1 and 2, a hitch, generally designated 10 and including main body 12, is pivotally connected to dipperstick 14 of a backhoe by hinge pin 16 and to guide link 18 by hinge pin 20 to rotate about an axis defined by pin 16, all as described in Arnold, U.S. Pat. No. 3,934,738. Further details of this connection and its operation may be found in this patent.

Bucket 22 is pivotally connected to main body 12, for rotation about axis 28 perpendicular to and below the axis defined by pin 16, by a front connector, generally designated 24, and a back connector, generally designated 26.

Main body 12 comprises a pair of side walls 30, to which hinge pins 16 and 20 are connected, and a receptacle 32 recessed between plates 30 adjacent the end of the body 12, and, spaced forward of receptacle 32, a pair of parallel connector support plates 36 and 38 welded between side walls 30. In cross section, receptacle 32 defines a rectangle open at its bottom, and a pair of apertures 34, axially aligned along axis 28 extend through its front and rear walls. Support plates 36 and 38 are perpendicular to axis 28, extend downwardly past axis 28, and are cut away along lines extending from below axis 28 to a point adjacent to side walls 30. A pair of holes 40, axially aligned along axis 28, extend through support plates 36 and 38.

Front connector 24 includes a connector pin 42 extending along axis 28 through holes 40 in connector plates 36, 38. Pin 42 is threaded to accept retaining nuts 44 and is held in connector plates 36, 38 by retaining nuts 44. The rounded, conical tip 49 of pin 42 extends through a slotted aperture 46 in bucket connector plate 48, which is generally triangular in shape (FIG. 3) and extends through aperture 52 in top wall 58 of bucket 22. Connector plate 48 is welded to top wall 58 and reinforcing plate 60, which in turn extends the width of bucket 22 and is welded to top wall 58 and side walls 62 of the bucket. The semi-cylindrical upper surface 50 of aperture 46 defines an arc of the same radius as pin 42, and the center of the arc is axially aligned along axis 28. Thus surface 50 and the circumferential surface of pin 42 form face-to-face bearing surfaces and permit bucket 22 to pivot relative to hitch 10 about axis 28 when the bucket is connected to the hitch as shown in FIGS. 1 and 2.

Back connector 26 includes parallel rear connector plates 64 welded to top wall 58 of bucket 22 and extending upwardly to lines coplanar with flat upper surface 66 of the bucket, and connector block 68 welded between plates 64 and extending upwardly to fit within receptacle 32. An aperture 70 extends through block 68 coaxial with axis 28, and a cylindrical boss 72 is mounted on block 68 coaxial with aperture 70. Locking pin 76 extends through apertures 34 in receptacle 32 and aperture 70 in block 68. Boss 72 engages the semi-cylindrical lower edge of an alignment stop 74, mounted on the inside front wall of receptacle 32 coaxial with aperture 34, and axially aligns apertures 34 and 70 along axis 28. Pin 76 thus pivotally connects bucket 22 to body 12 for rotation about axis 28 with the pin, apertures 34 and 70, and cylindrical surfaces of stop 74 and boss 72 forming respective face-to-face bearing surfaces.

For pivoting bucket 20 relative to body 12, a bearing sleeve 78 extends between support plates 36, 38 of body 12 coaxially surrounding pin 42, and supports a U-shaped bracket including a horizontal bottom plate 80 and a pair of arms 82, 84. Bearing sleeve 78 is free to rotate relative to pin 42; and passes through apertures in and is welded to bracket arms 82, 84. The lower face 86 of plate 80 engages the upper surface 66 of bucket 22. Hydraulic cylinder 88 and piston 90 are secured between bracket arms 82, 84 and a projecting abutment 94 at a side wall 30 of body 12. Pivot pins 92 connect a central portion of cylinder 88 to bracket arms 82, 84 above sleeve 78. Pin 96 connects piston 90 to abutment 94. Hydraulic lines 98 provide for the flow of hydraulic fluid to and from cylinder 88 to rotate arms 82, 84, and, thus, bearing plate 80 and bucket 22, about axis 28.

FIG. 5 shows one way in which bucket connector plate 48 may be modified. As shown, slotted aperture 46 is replaced by self-aligning bushing 548 having aperture 546 axially aligned along axis 28.

Figure 7:
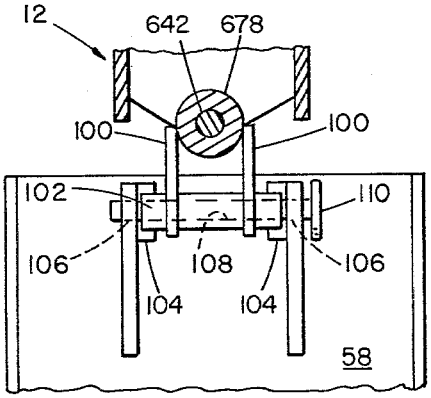
FIG. 7 is an end view partially in section, of portions of the apparatus of FIG. 6.

FIGS. 6 and 7 show a modification in which the functions of rear connector 26 and bracket plate 80 and arms 82, 84 are combined. Pin 642 extends the full length of main body 12, along axis 28, and is pivotally supported by supports 636, 638 near the front and at the back of main body 12. Sleeve 678 extends between support plates 636, 638 and is connected to hydraulic cylinder 88 by arms 682 and 684, which are welded to the peripheral surface of the sleeve and connected to pivot pins 92 to control the rotational position of sleeve 678 about axis 28. Rear connector 626 includes parallel bucket engaging arms 100 welded to diametrically opposite sides of sleeve 678, and extending downwardly between connector plates 664 at the rear of bucket 22. A cylindrical sleeve 102 extends through and is welded to arms 100, extending between the inner surfaces of plates 664 along an axis perpendicular to plates 664 and arms 100. The opposite end portions of sleeve 102 engage rearwardly-facing semi-circular surfaces defined by alignment stops 104 welded to the inner surfaces of plates 664 with the semi-circular surfaces thereof concentric with axially aligned apertures 106 extending through plates 664. As will be seen, stops 104 axially align bore 108 through sleeve 102 with apertures 106. Pin 110 through sleeve 102 locks arms 100 in place between plates 664, thereby rigidly connecting bucket 22 to sleeve 678 for rotation about axis 28.

Figure 8:
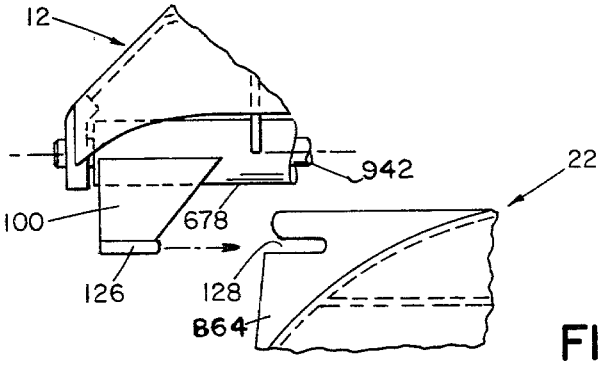
FIG. 8 is a side view of a modification for the systems of FIGS. 6 and 7.

If desired, rear connector 626 may be modified as shown in FIG. 8. As thus shown, a cross plate 126 is welded to the bottoms of arms 100 which project downwardly from sleeve 678 and extend through slots 128 in bucket rear connector plates 864. The outer ends of slots 128 are flared to help guide the plate into the slots; and the bucket is held in place by a retaining pin system such as that described below with reference to FIG. 9.

Figure 9:
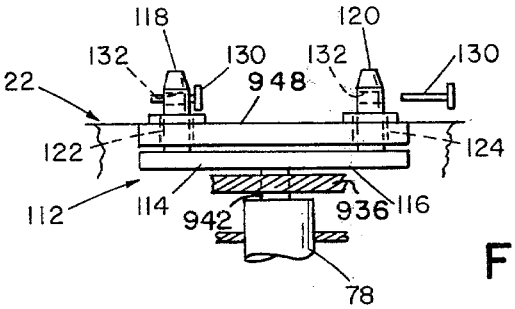
FIG. 9 is a plan view of a modification of portions of the system of FIGS. 1–4 or 6 and 7.

The front connector 24 of any of the heretofore described systems may be modified as shown in FIG. 9. Pin 942 is terminated midway between support plate 936 and front connector plate 948, and cross bar 114 is welded on the front of and at right angles to pin 942 so as to rotate with pin 942. Short connecting pins 118 and 120 project, parallel to axis 28, from the side of bar 112 opposite pin 942 and towards connector plate 948, passing through respective apertures 122 and 124 in plate 948. The pins are held in place in the apertures 122, 124 by pins 130 extending diametrically through pins 118 and 120 forward of bucket connector plate 948. To provide the width necessary for two apertures, connector plate 948 is generally rectangular rather than triangular. Apertures 122 and 124 themselves may either be slotted apertures, as shown in FIG. 3, or may contain self-aligning bushings, as in FIG. 5.

OPERATION

Referring to FIG. 1, hitch 10 is initially positioned above and longitudinally closely adjacent bucket 22, with pin 42 laterally aligned with aperture 46 in bucket connector plate 48. In this position, axis 28, and pin 42, make an acute vertical angle with aperture 46. Guide link 18 is then extended, causing hitch 10 to rotate about pin 16 and inserting pin 42 into aperture 46 as axis 28 and aperture 46 come into alignment. Continued rotation results in plate 80 of body 12 coming into face-to-face engagement with upper surface 66 of the bucket and boss 72 of connector block 68 coming into engagement with stop 74 in receptacle 32, forcing the upper circumferential surface of pin 42 into face-to-face engagement with surface 50 of aperture 46. Locking pin 76 is then inserted through apertures 34 in receptacle 32 and aperture 70 in block 68 and extension 72 and turned 90° to lock it in place. The conical tip of pin 42, cooperating with the increased vertical dimension of aperture 46, or in the FIG. 5 modification, the self-aligning feature of bushing 548, allows easy engagement of pin 42 with connector plate 48 by providing a guiding, or funneling effect during the connecting operation. The bucket is then ready for use, with guide link 18 controlling the rotational position of the bucket about pin 16 and hydraulic cylinder 88 and piston 90 controlling the rotational position of the bucket about axis 28.

A bucket 22 having a rear connector of the type shown in FIGS. 6, 7 and 8, is connected to its hitch in a similar manner except that, as shown in FIG. 6, the hitch and bucket are moved together along a straight line coaxial with axis 28. The flared outer ends of slots 128 (FIG. 8) or the aligning surface of alignment stops 104 (FIGS. 6,7) assist the connecting operation by limiting forward movement of hitch 10 relative to the bucket and, in the FIG. 6 and 7 system, aligning the aperture for connecting pin 110.

Once the bucket is in place, bucket 22 may be swung about axis 28 relative to body 12 simply by activating hydraulic cylinder 88, thereby pivoting arms 82, 84, 682, 684. In the FIG. 1 system, pivoting arms 82, 84 also swings plate 80 which is in face-to-face engagement with the top 66 of bucket 22; in the FIGS. 6 and 7 system, pivoting arms 682, 684 swings arms 100 welded to sleeve 678 and attached to bucket rear connector plates 664.

Still other embodiments and modifications will be within the scope of the following claims. For example, in some embodiments the body and bucket will not be relatively pivotable about axis 28 and the hydraulic cylinder 88 and sleeve 78, 678 may be omitted. In such systems, the sides 30 of hitch 12 may extend down between rear connector plates 64 (in lieu of arms 100 of FIGS. 6–8) or may engage the top 66 of bucket 22 (in lieu of plate 80 of FIG. 1). In other embodiments, plate 60 may be replaced by a downwardly extending lip of plate 58, extending between side walls 62 and to the lower edge of plate 48; or slotted aperture 46 or self-aligning bearing 548 may be replaced by a tapered journal bearing or, in the embodiments of FIGS. 6, 7 and 9, by a straight journal bearing.

What is claimed is:

1. In apparatus for releasably securing a materials handler to a boom while permitting rotation of said materials handler relative to said boom about relatively perpendicular first and second axes, said second axis being on the side of said boom opposite said first axis and said apparatus including a hitch adapted for pivotal connection to said boom for rotation about said first axis and for connection to said materials handler for providing said rotation about said second axis, that improvement comprising:

a first connector system including a first hitch connector adjacent said first axis and a first materials handler connector, said first hitch connector having (i) a projecting axially-fixed pin attached to said hitch and extending generally along said second axis and having a circular in cross-section tapered nose at one end thereof and (ii) a cylindrical sleeve surrounding said pin, and said first materials handler connector including a member projecting upwardly beyond the top of said material handler and defining an aperture for receiving said projecting nose of first hitch connector pin when said hitch and said handler are moved relatively together;

a second connector system spaced from first connector system and including (i) a recess defined by said materials handler and a pair of axially aligned apertures extending through opposite walls of said recess with the axes of said apertures generally parallel to said axis and (ii) a projection defined by said hitch and arranged to fit within said recess when said tapered nose is fitted within said aperture of said first connector system;

an arm attached to said sleeve, defining said projection of said connector system and extending downwardly into said recess in a direction generally perpendicular to said second axis; and, means for rotating said sleeve and said arm about said second axis, whereby said rotation of said arm causes said materials handler to rotate about said second axis.

2. The improvement of claim 1 wherein said pin defines said tapered nose.

3. The improvement of claim 2 wherein said hitch includes a pair of support plates spaced along said second axis and supporting said pin, said sleeve extends between said support plates, and a pair of said arms are attached to and project parallel to each other from opposite sides of said sleeve.

4. The improvement of claim 3 including a cross-member extending between and generally perpendicular to said arms and engaging said materials handler.

5. The improvement of claim 1 wherein said pin is circular in transverse cross-section, and said aperture of same materials handler defines a downwardly-facing generally semi-cylindrical surface arranged to engage the exterior surface of said pin.

6. The improvement of claim 5 wherein said first hitch connector includes a pair of connector pins each extending generally parallel to and spaced on opposite sides of said second axis, and said materials handler includes members defining a pair of said apertures each arranged to receive a respective one fo said connectors pins, either said pair of pins or said pair of apertures being rotatable as a unit about second axis.

7. The improvement of claim 5 wherein said aperture of said materials handler is oblong in cross-section perpendicular to said second axis, the long dimension of said aperture being generally perpendicular to both of said first and second axes.

8. The improvement of claim 1 wherein said arm and includes a cross member projecting therefrom, said apertures of said recess are open at one side thereof, and said cross member is arranged to fit within said apertures of said recess.

* * * * *

UNITED STATES PATENT AND TRADEMARK OFFICE

CERTIFICATE OF CORRECTION

PATENT NO. : 4,345,872

DATED : August 24, 1982

INVENTOR(S) : Carroll H. Arnold

It is certified that error appears in the above-identified patent and that said Letters Patent are hereby corrected as shown below:

Column 1, line 35 delete "or"

Column 6, line 28 "fo" should be --of--.

Signed and Sealed this

Second Day of November 1982

[SEAL]

*Attest:*

GERALD J. MOSSINGHOFF

*Attesting Officer*

*Commissioner of Patents and Trademarks*